United States Patent [19]

Catterfeld

[11] 4,428,717

[45] Jan. 31, 1984

[54] COMPOSITE CENTRIFUGAL IMPELLER FOR SLURRY PUMPS

[75] Inventor: Fritz C. Catterfeld, Canoga Park, Calif.

[73] Assignee: Rockwell International Corporation, El Segundo, Calif.

[21] Appl. No.: 303,739

[22] Filed: Sep. 21, 1981

Related U.S. Application Data

[63] Continuation-in-part of Ser. No. 88,886, Oct. 29, 1979, abandoned.

[51] Int. Cl.[3] ..... F04D 29/28

[52] U.S. Cl. ..... 416/186 R; 416/224; 415/214; 29/156.8 CF

[58] Field of Search ..... 416/241 R, 186 R, 224; 415/214; 29/156.8 CF

[56] References Cited

U.S. PATENT DOCUMENTS 2,882,829 4/1959 Wade ..... 416/186 R

FOREIGN PATENT DOCUMENTS 407633 4/1934 United Kingdom .
632475 11/1949 United Kingdom ..... 416/186
1173455 12/1969 United Kingdom .

*Primary Examiner*—Harvey C. Hornsby
*Assistant Examiner*—Christine A. Peterson
*Attorney, Agent, or Firm*—H. Fredrick Hamann; Harry B. Field

[57] ABSTRACT

A highly wear-resistant impeller for centrifugal pumps of composite construction comprising a base and a cover plate formed of material which can be worked with relative ease and an insert sandwiched between said base and cover plate formed of high temperature and wear-resistant material.

11 Claims, 5 Drawing Figures

Fig. 4
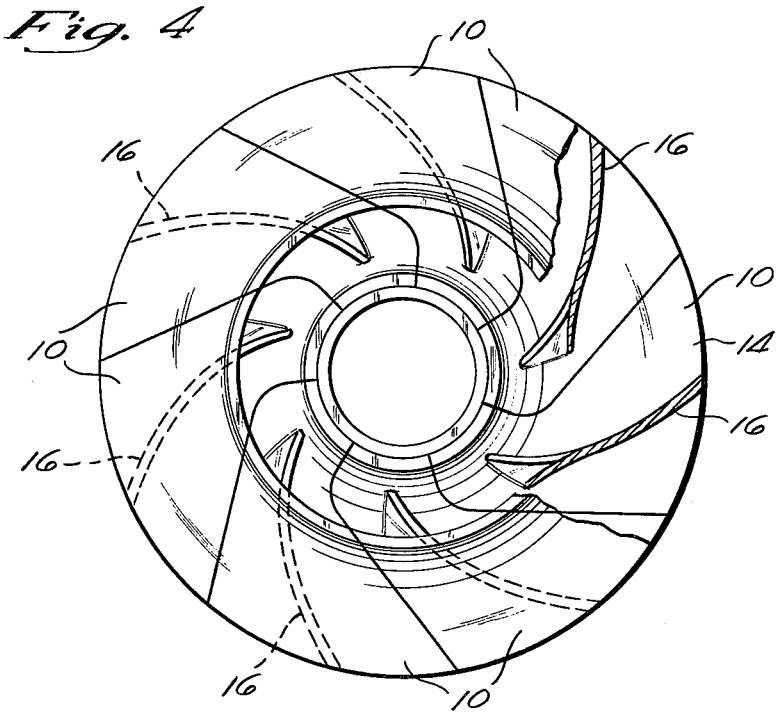
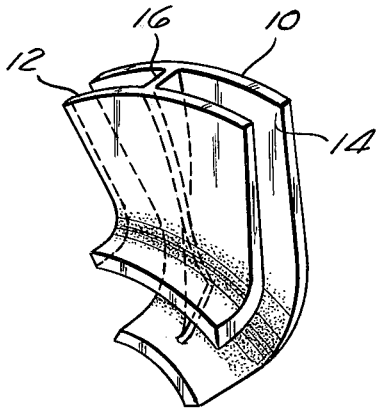
Fig. 5

COMPOSITE CENTRIFUGAL IMPELLER FOR SLURRY PUMPS

CROSS-REFERENCE TO RELATED APPLICATION

This is a continuation-in-part of applicant's prior copending application Ser. No. 88,886 filed Oct. 29, 1979, now abandoned.

BACKGROUND OF THE INVENTION

1. Field of the Invention

This invention relates to pumps and is particularly directed to a composite impeller for use in centrifugal coal slurry pumps and the like.

2. Description of the Prior Art

In attempting to overcome the energy crisis, numerous techniques have been proposed for converting coal into oil, gas or the like. Most of these techniques involve pulverizing the coal and combining it with a suitable fluid to form a slurry which is transported through the process by pumping. Unfortunately, such slurries are extremely abrasive and tend to jam piston pumps, while the slurries act like a stream of sandblast on centrifugal pumps, causing high maintenance and greatly reducing the life of the pump. Moreover, coal slurries tend to be highly carcinogenic so that frequent maintenance of the pumps involves a serious health hazard. Moreover, coal conversion processes generally require that the coal slurries be maintained at temperatures of 300°-600° F. Few impeller materials can withstand such temperatures. It has been proposed to form the pump components of high temperature and wear-resistant materials, such as tungsten carbide and the like. However, such materials are expensive and extremely difficult to fabricate, causing the cost of such pumps to be prohibitive. Thus, no satisfactory solution to this problem has been found in the prior art.

SUMMARY OF THE INVENTION

The disadvantages of the prior art are overcome with the present invention and a composite impeller is proposed which substantialy increases the life of centrifugal pumps, while significantly reducing pump cost and maintenance.

The advantages of the present invention are preferably attained by providing a composite impeller having a base and a cover plate, formed of conventional material, and an insert comprised of a plurality of individual segments, formed of high wear-resistant material and sandwiched between the base and cover plate. The segments are formed to minimize fabrication expense and to withstand direct impingement wear by the heated coal slurry.

OBJECTS OF THE INVENTION

Accordingly, it is an object of the present invention to provide an improved impeller for centrifugal slurry pumps and the like.

Another object of the present invention is to provide an impeller for slurry pumps and the like which is highly temperature and wear-resistant, while providing relatively inexpensive fabrication and ease of maintenance.

A further object of the present invention is to provide a composite impeller for slurry pumps and the like comprising a base and a cover plate, formed of conventional materials and an insert, having a plurality of individual segments formed of high temperature and wear-resistant material, sandwiched between said base and said cover plate.

These and other objects and features of the present invention will be apparent from the following detailed description taken with reference to the accompanying drawings.

BRIEF DESCRIPTION OF THE DRAWINGS

FIG. 4 is a plan view of the impeller of FIG. 1 with the cover plate removed; and FIG. 5 is an isometric view of one of the insert segments of the impeller of FIG. 1.

DESCRIPTION OF THE PREFERRED EMBODIMENTS

Figure 1:
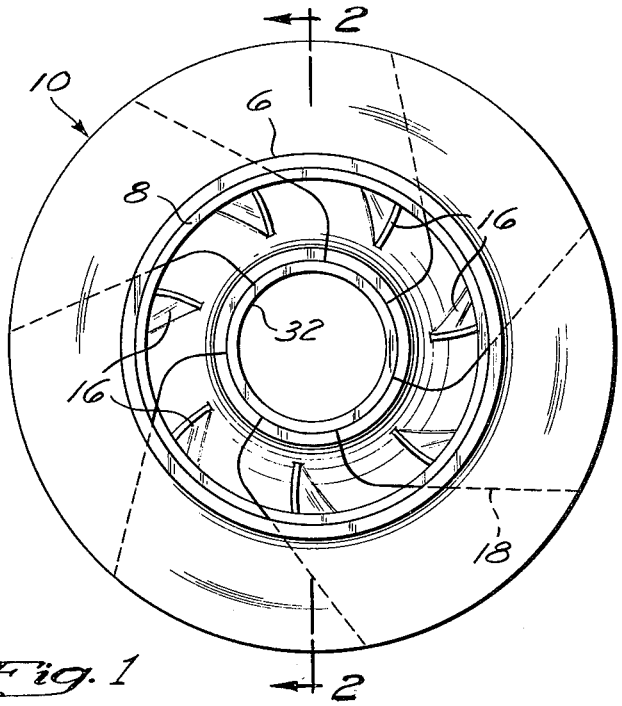
FIG. 1 is a plan view of an impeller embodying the present invention.
Figure 2:
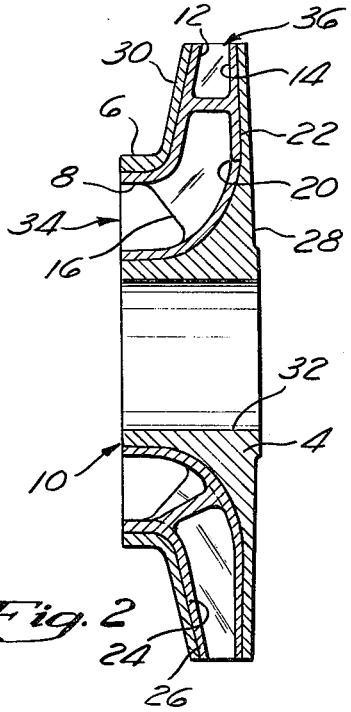
FIG. 2 is a vertical section through the impeller of FIG. 1.
Figure 3:
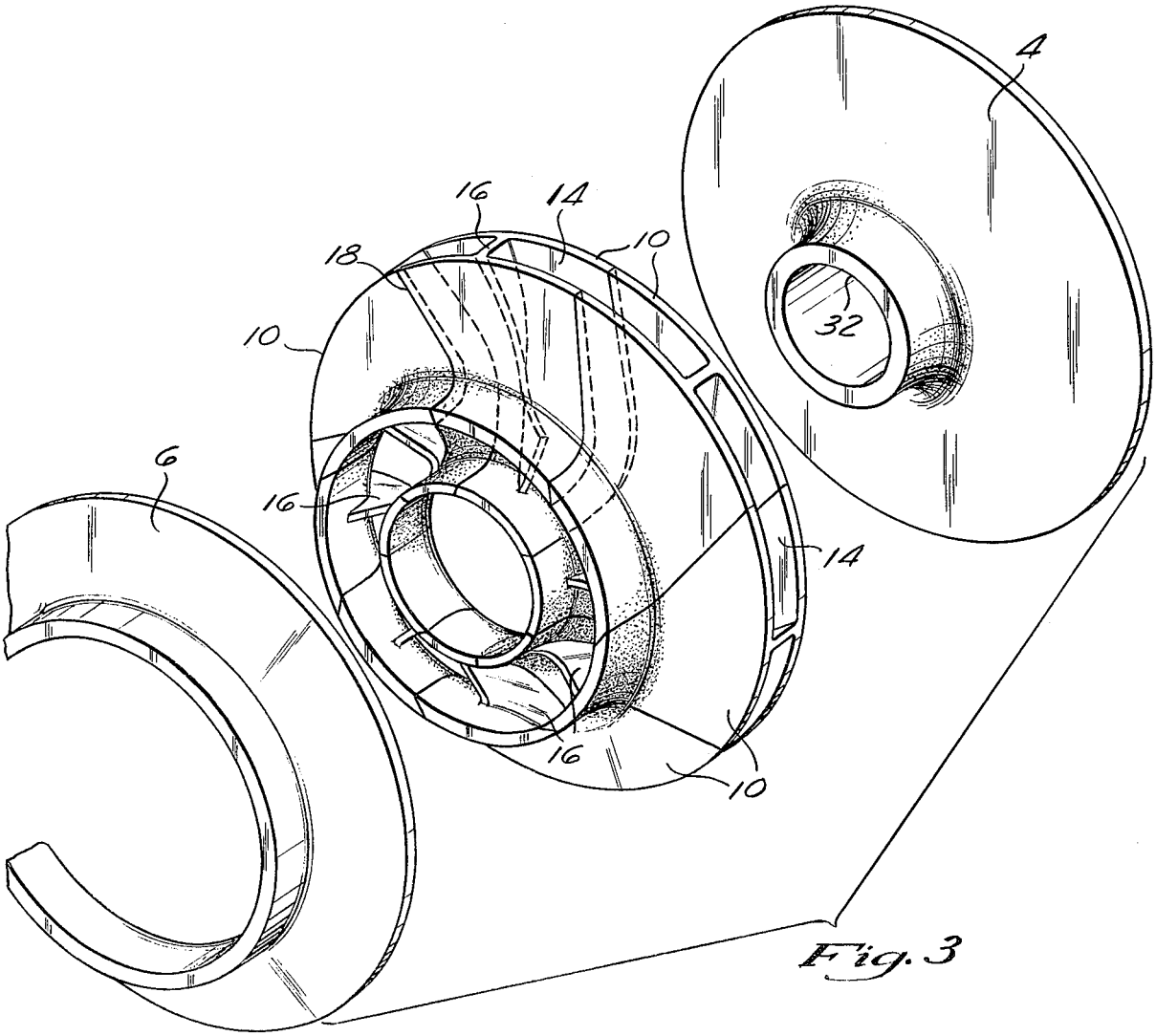
FIG. 3 is an exploded view of the impeller of FIG. 1.

In that form of the present invention chosen for purposes of illustration, FIGS. 1-3 show an impeller, indicated generally at 2, having a base 4, a cover plate 6 and an insert 8. The base 4 and cover plate 6 are formed of conventional materials, such as steel, which are relatively inexpensive and easy to fabricate. The insert 8 is formed of a plurality of individual segments 10 which are composed of highly temperature and wear-resistant material, such as tungsten carbide, aluminum oxide and the like.

Unfortunately, high temperature and wear-resistant materials are extremely difficult and expensive to work. Casting and machining of such materials are virtually impossible. Accordingly, fabrication of an impeller from such materials would be prohibitive. The present invention overcomes this difficulty by forming the base 4 and cover plate 6 of materials, such as steel, which are relatively inexpensive and easy to work. These portions of the impeller 2 do not receive direct impingement by the slurry flow and, hence, are not as severely affected by the temperature and abrasive nature of the slurry. The insert 8, which is exposed to the most severe conditions, is comprised of a plurality of individual segments 10 which are formed of high temperature and wear-resistant material, such as tungsten carbide, aluminum oxide, and the like. It has been found that the segments 10 can be formed easily and inexpensively by injection molding or machining before cintering, even though high temperature and wear-resistant materials are used.

As best seen in FIGS. 4 and 5, each of the segments 10 is generally H-shaped in transverse section, having an upper flange 12 and a lower flange 14 separated by a vertical member 16 which serves as a drive vane for the slurry when the impeller is assembled. Referring to FIG. 1 at the inner periphery 17 of insert 8, the opposite edges 18 of each segment 10 extend along radii of the impeller for a short distance and thus curve approximately 51° and continue in a straight line to the outer periphery 19 of the impeller. In this way, when the segments 10 are assembled to form the insert 8, the segments 10 become locked in position.

The upper surface 20 of the base 4 is shaped to conform to that of the outer surface 22 of the lower flanges 14 of the segments 10 and the segments 10 are assembled on the base 4 to form the insert 8. Upper surface 20 preferably includes the outer annulus 21 of the forwardly extending hub section 23 of backplate 4. The lower surface 24 of the cover plate 6 is shaped to comform to the outer surface 26 of the upper flanges 12 of the segments 10 and, when assembled, as seen in FIG. 2, serves to lock the segments 10 in place. Cover plate 6 includes a forwardly extending flange 27 and bearing surfaces 29 which surfaces 29 preferably include the inner annulus 31 of flange 27. As best seen in FIG. 5, lower flange 14 of each segment 10 includes a forwardly extendingsection 33 for engagement with outer annulus of hub section 23 and upper flange 12 of each segment 10 includes a forwardly extending section 35 for engagement with inner annulus 31 of cover plate 6. To form the completed impeller, the base 4, segments 10 and cover plate 6 are bonded together by suitable means, such as brazing.

The impeller 2 must impart energy from the rotating shaft, not shown, into the pumping fluid. This requires the impeller 2 to be attached to the shaft by some means which will be able to transmit the torque into the impeller 2. In prior art pumps, this is often done by means of a key imbedded into the shaft which will meet with the key slot machined into the impeller. In the slurry pump, the impeller 2 must be able to receive and transmit into the pumping fluid the equivalent of 500 horsepower which translates at the pump speed of 3600 rpm into 8,750 inch/lbs of torque. A material like steel, which has a Youngs modulus of elasticity of 30,000,000, can be heat treated to any desired strength level within the chemistry of the steel. A sintered material like tungsten carbide with a Youngs modulus of elasticity of 90,000,000 is extremely hard and brittle and would shatter without the aid of the steel backplate or base 4. The backplate or base 4 is the actual driving element and the transmitter of the torque into the hard tungsten carbide pumping vane segments 10 which are sandwiched between the backplate 4 and the front shroud or cover plate 6. The front shroud 6 is of the same steel material as the backplate 4. Since the pump is designed to operate at high temperature (600° F.) the shaft material and the backplate material of the impeller must be comparable in thermal expansion. If the impeller were made in one piece from tungsten carbide and then fitted to a steel shaft at normal room temperature, the thermal growth of the steel shaft, which is about twice that of the tungsten carbide impeller, could develop enough expansion force to destroy the impeller by cracking it like a section of glass. Both these considerations, thermal growth and torque transmission rule out the use of an impeller made entirely out of tungsten carbide. The operating requirement of the impeller is to withstand the slurry abrasion for a period of one year or about 9000 hours. However, due to the extreme abrasiveness of coal slurry, actual test data indicates that an impeller made from steel would be destroyed within about 1000 hours of operation regardless of hardness. The impeller design of the present invention is such that only the internal passages will be subjected to the abrasive wear of the hot slurry. The internal passages are formed by the segments 10, which are made from tungsten carbide, the hardest material technology can provide and it has proven in tests to withstand the abrasive wear best of all materials known. The tungsten carbide hard metal segments 10 are attached to the backplate 4 and the front shroud 6 by fusion or bonding with a resilient, medium-temperature, brazing alloy, such as that available under the trade name "Tobin bronze", available from Kennametal Inc., Latrobe, Pennsylvania, or the brazing compounds RB0170-170 or RB0170-217, formulated by the Rocketdyne Division, Rockwell International Corporation, Canoga Park, Calif. At temperatures of about 500° F.–600° F., these braze alloys are sufficiently fluid to accommodate the differential expansion between the base 4, cover plate 6 and the segments 10. At the same time, these braze alloys have tensile strengths of the order of 50,000 psi which is sufficient to assure the integrity of the impeller 2, while transmitting the driving torque to the segments 10.

In use, outer surface 28 of the base 4 and outer surface 30 of the cover plate 6 may be easily machined to provide tolerances and the base 4 is formed with an axial opening 32 extending therethrough which may be easily machined to provide key slots, splines, etc., for attaching the impeller to a drive shaft. Slurry to be pumped enters the impeller through inlet openings 34 formed by the segments 10 of insert 8 and is engaged by the vertical members 16 of the segments 10 which serve as drive vanes, when the impeller is rotated, and drive the slurry radially outward through openings 36. Thus, the slurry is received and driven by the segments 10 of insert 8, which are formed of high temperature and wear-resistant material and has little, if any, contact with the base 4 and cover plate 6.

Thermal expansion differential between the hard insert and the steel backplate and shroud is accommodated by the segmented insert construction. The backplate and shroud may expand freely without restraint from the hard insert which coefficient of thermal expansion is lower than that of steel. The segments will therefore "float" on the bonding interface between the segments and the backplate and shroud and will still be securely locked in place.

Obviously, numerous variations and modifications can be made without departing from the present invention. Accordingly, it should be clearly understood that the form of the present invention described above and shown in the accompanying drawings is illustrative only and is not intended to limit the scope of the present invention.

What is claimed is:

1. A composite impeller suitable for use in pumps handling hot, highly abrasive slurries and having a drive shaft, said impeller comprising:

a disk shaped backplate comprising an axial forwardly extending hub section and an axial opening extending through said hub for securing said backplate to said drive shaft, said backplate being constructed from material comparable in thermal expansion to said drive shaft;

a cover plate having a forwardly extending flange concentric to said hub, said cover plate being constructed from material comparable in thermal expansion to said drive shaft, a radially segmented insert forming the working surfaces of said impeller sandwiched between said backplate and said cover plate, said segmented insert being constructed from high temperature and wear resistant material and having forwardly extending sections extending between and entirely covering said hub and said flange for matably engaging said hub and said flange and for protecting said hub and said flange from abrasive wear;

bonding material joining said insert to said backplate and said cover plate, said bonding material being constructed from brazing alloy which at the operating temperature of said pumps allows said insert to float between said backplate and said cover plate to accomodate the differences in thermal expansion between said backplate, said cover plate and said radially segmented insert, yet retains sufficient tensile strength to transmit driving torque to said radially segmented insert.

2. The composite impeller as claimed in claim 1 wherein each segment comprising said segmented insert is generally H-shaped in transverse sections and has an upper and a lower flange portion joined by a vertical member, said vertical member serving as a slurry driving vane, each lower flange member having a forwardly extending section for engagement with the outer annulus of said hub section, each upper flange member having a forwardly extending section for engagement with the inner annulus of said flange of said cover plate.

3. The composite impeller as claimed in claim 2 wherein said plurality of adjoined segments have opposing edges defining lines of contact, each of said lines of contact, when said insert is viewed in the axial direction, running initially in a radial direction from the inner periphery of said insert and then angulating to continue in a line to the outer periphery of said insert.

4. The composite impeller as claimed in claim 3 wherein said lines of contact angulate at an angle of approximately 51° from the radial direction.

5. The composite impeller as claimed in claim 1 wherein said brazing alloy is Tobin bronze.

6. The composite impeller as claimed in claim 1 wherein said brazing alloy is from the group comprising RB0170-170 or RB0170-217.

7. The composite impeller as claimed in claim 3 wherein said brazing alloy is Tobin bronze.

8. The composite impeller as claimed in claim 3 wherein said brazing alloy is from the group comprising RB0170-170 or RB0170-217.

9. The impeller of claim 2 wherein said backplate and said cover plate are formed of steel.

10. The impeller of claim 2 wherein said insert is formed of tungsten carbide.

11. The impeller of claim 2 wherein said insert is formed of aluminum oxide.

* * * * *